United States Patent [19]

Surti

[11] Patent Number: 5,019,861

[45] Date of Patent: May 28, 1991

[54] DRIVE APPARATUS FOR A PROCESS CARTRIDGE OF AN IMAGE-FORMING APPARATUS

[76] Inventor: Tyrone N. Surti, 424 Harding Industrial Dr., Nashville, Tenn. 37211

[21] Appl. No.: 419,963

[22] Filed: Oct. 11, 1989

[51] Int. Cl.[5] ..... G03G 15/00

[52] U.S. Cl. ..... 355/200

[58] Field of Search ..... 355/200, 210, 211

[56] References Cited

U.S. PATENT DOCUMENTS

| | | | |
|---|---|---|---|
| 2,887,023 | 5/1959 | Young | 355/211 |
| 3,653,756 | 4/1972 | Mielnikowski Jr. et al. | 355/210 |
| 4,120,576 | 10/1978 | Babish | 355/200 |
| 4,376,579 | 3/1983 | Wakao | 355/211 |
| 4,420,149 | 12/1983 | Schultes et al. | 355/318 X |
| 4,823,160 | 4/1989 | Ikuta et al. | 355/211 |
| 4,829,335 | 5/1989 | Kanemitsu et al. | 355/211 |
| 4,833,502 | 5/1989 | Azuma | 355/211 X |

*Primary Examiner*—R. L. Moses
*Assistant Examiner*—Nestor R. Ramirez
*Attorney, Agent, or Firm*—Philips & Beumer

[57] ABSTRACT

A buffering device for use with a process cartridge disposed for detachable mounting in an image-forming apparatus. The buffering device is disposed for buffering the longitudinal movement of a photosensitive member relative to the casing of the process cartridge and, also if desired, for buffering the longitudinal movement of the process cartridge casing relative to a reference wall of the image-forming apparatus. The longitudinal movement is in response to rotation of a helical gear mounted on the rotatable photosensitive member by a helical gear on a drive shaft of the image-forming apparatus. The buffering device also is disposed for imparting a reciprocal longitudinal movement to the photosensitive member and the casing.

12 Claims, 2 Drawing Sheets

DRIVE APPARATUS FOR A PROCESS CARTRIDGE OF AN IMAGE-FORMING APPARATUS

FIELD OF THE INVENTION

The present invention relates generally to a process cartridge for use in an image-forming apparatus and more particularly to the driving system for the photosensitive member, such as a drum which is mounted in the process cartridge.

BACKGROUND OF THE INVENTION

Process cartridges which are detachably mounted in image-forming apparatus are well known in the art. Also, it is well known in the art to provide structure for holding a part of the casing of the process cartridge by a positioning member mounted in the main assembly of the image-forming apparatus. Such structure is disclosed in U.S. Pat. Nos. 4,591,258; 4,566,777; 4,575,221; and 4,588,280.

Typically, a small clearance is provided between the casing and the ends of the drum so that the photosensitive drum may rotate smoothly. Typically, the drum is provided with a helical gear at one end thereof for meshed relation with a second helical gear of the output shaft of the image-forming apparatus which imparts a longitudinal thrust force on the drum, which also imparts a longitudinal force and displacement of the casing while simultaneously rotating the drum. Such longitudinal force displaces the photosensitive drum and casing in the direction of the positioning member of the image-forming apparatus and thus creates excessive friction between the end of the rotating drum and casing once the casing has come to rest against the positioning member of the image-forming apparatus.

It is an object of the present invention, therefore, to provide a process cartridge for use in an image-forming apparatus with mechanism to restrain inherent longitudinal movement of the cartridge in the image-forming apparatus responsive to rotation of a photosensitive member carried in the process cartridge.

SUMMARY OF THE INVENTION

A drive apparatus for a photosensitive medium of an image-forming apparatus. The photosensitive medium includes a helical gear secured thereto for rotation by a second driving helical gear. The helical gear arrangement inherently imparts longitudinal movement to the rotating photosensitive member and any mechanism to which the photosensitive member is attached. The present invention provides a buffering member positioned between the longitudinally movable member and other members of the image-forming apparatus with which the longitudinally movable members may engage.

DESCRIPTION OF THE PREFERRED EMBODIMENT

Figure 1:
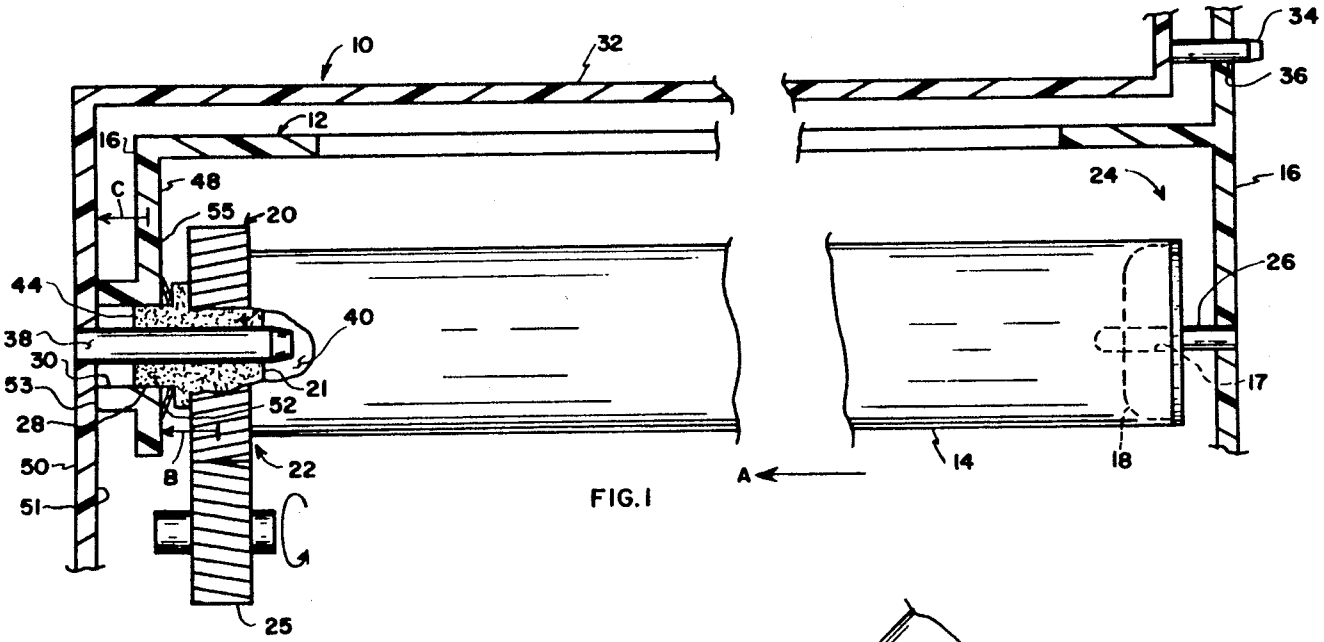
FIG. 1 is a partial elevational sectional view of a process cartridge mounted in an image-forming apparatus and includes the buffering device of the present invention mounted adjacent to the helical gear of the photosensitive member.

As seen in FIG. 1, a portion of an image-forming apparatus 10 is shown to be enclosing a process cartridge 12 having a photosensitive drum 14 rotatably mounted in the casing 16 thereof. A pair of drum supports 18 and 21 are affixed to the opposite ends 24 and 22 of the drum. A drum gear 20 integral with support 21 is disposed for meshing relation with an output drive gear 25 of the image-forming member. The process cartridge includes casing 16 having a drum positioning pin 26 which is inserted into a central bore 17 of plug 18, and a portion 28 of the drum gear support 21 is inserted into a bore 30 of the cartridge casing so that the photosensitive drum is rotatably supported in the casing. A main assembly 32 of the copying apparatus 10 has a positioning pin 34 which is inserted into a hole 36 of the process cartridge casing when the process cartridge is inserted into the main assembly in a direction indicated by an arrow A in FIG. 1. Also, a pin 38, mounted to main assembly 10, is inserted into a central bore 40 of the drum 14. Thus, the process cartridge is detachably received by the main assembly of the image-forming apparatus 10. The main assembly 32 has helical gear 25 meshable with the aforementioned helical gear 20 of the process cartridge.

As shown in FIG. 1, the drum gear 20 is helically turned counterclockwise by helical gear 25 which is effective to rotate the photosensitive drum and to thrust the drum longitudinally in the leftward direction as indicated by the arrow B. It can be seen, therefore, as a result of rotation of the helical gear, the drum is leftwardly urged.

Figure 4:
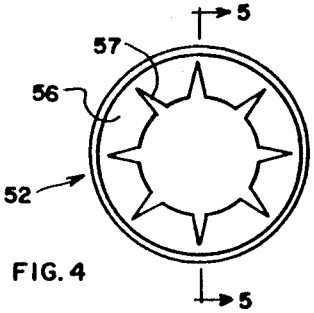
FIG. 4 is an elevational view of the buffering device of FIG. 1.
Figure 5:
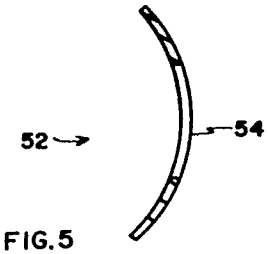
FIG. 5 is a sectional view taken along line 5—5 of FIG. 4.
Figure 3:
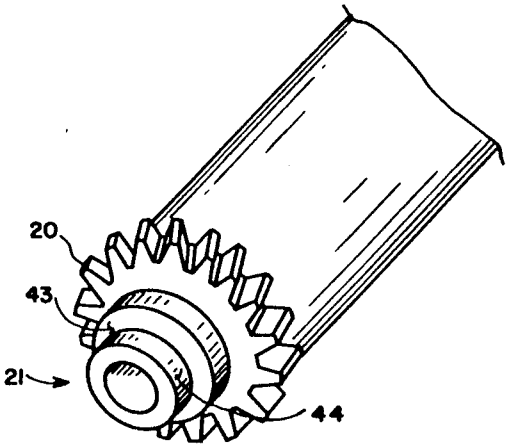
FIG. 3 is a pictorial view of the drum and helical gear arrangement.
Figure 2:
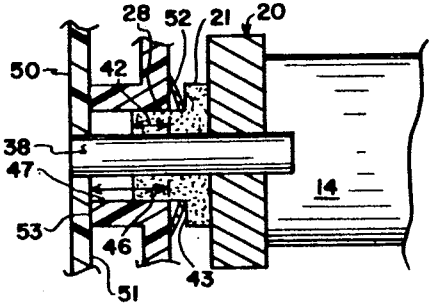
FIG. 2 is a partial view of the process kit of FIG. 1 illustrating the relative movement between the contacting surfaces of the drum, casing, and main frame of the image-forming apparatus.
Figure 6:
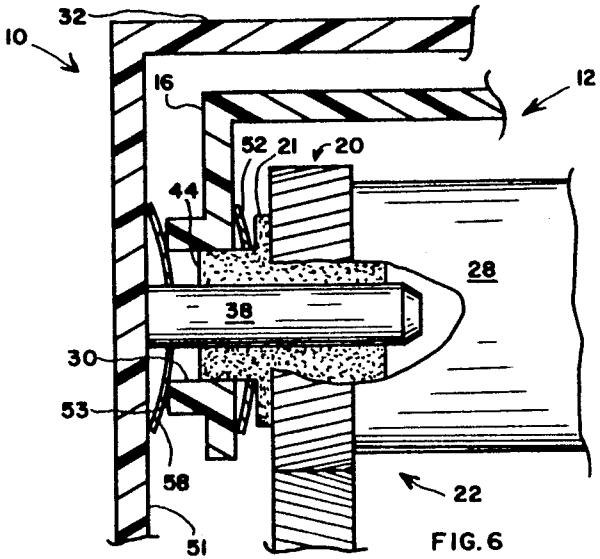
FIG. 6 is an elevational view, partly in section, similar to FIG. 1 illustrating another embodiment of the present invention in which two buffering members are used.
Figure 8:
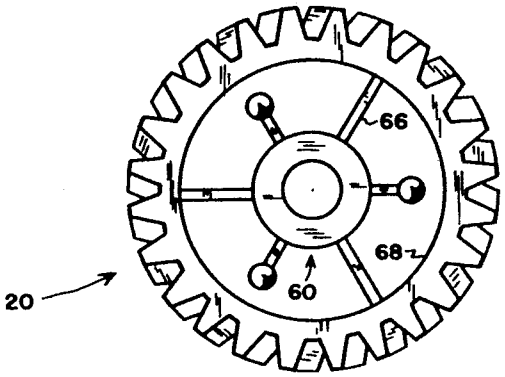
FIG. 8 is a view taken along line 8—8 of FIG. 7.

As shown in FIG. 2, the length 42 of the portion 44 (FIG. 3) of the drum gear 20 is shorter than a length 46 of extending portion 47 of the casing, and therefore the base portion 43 (FIG. 2) of drum gear 20 pushes the portion 48 and extending portion 47 of the casing to the left (arrow C). Thus, the entire cartridge is urged to a portion 50 of the main frame assembly. The portion 50 of the main assembly is a reference positioning surface, to which a particular portion of the process cartridge is abutted. However, as a result of the longitudinal displacement of the drum into this abutting relation, an impact force is generated between an inner surface 51 of the main frame and the end 53 of the casing. Additionally, as the drum gear 20 continues to rotate against the inner surface 55 of the casing, an undesirable frictional engagement is made to occur. To prevent the impact and to minimize the frictional contact, a shock-absorbing, buffering, low-friction impacting member 52 is positioned between inner surface 55 of casing 12 and the end surface 43 (FIG. 2) of the drum gear 20. Member 52 may be made of spring material to absorb the initial contact between the gear 20 and the surface 55 of the casing. Member 52 may be a single solid annular member or, as seen in FIG. 4, member 52 may be provided with a plurality of individual, radial, inwardly extending segments 56 having a space 57 between to enhance the resiliency of the buffering member. Additionally, member 52 is provided with a low coefficient of friction to substantially eliminate the undesirable frictional forces between the casing and gear 20. As shown in FIG. 5, the buffering member 52 may be provided with a convex-concave configuration, with the surface 43 of the gear 20. The member may be made of a material having a low coefficient of friction or may be provided with a low-friction coating of Teflon TM or the like to provide the low-friction surface. FIG. 6 illustrates an embodiment of the invention wherein a second buffering member 58 is positioned around shaft 38 between end surface 53 and inner surface 51 of the main frame. Member 58 may be used in conjunction with or in lieu of buffering member 20.

It is to be understood that the buffering member may be made integral with other components of the copier, if desired. For example, the buffering member may be made integral with gear 20 or the inner surface 48 of casing 16. Similarly, the buffering member may be made integral with the inner surface 51 (FIG. 6) of assembly 32 or with end surface 53 of casing 16.

Figure 7:
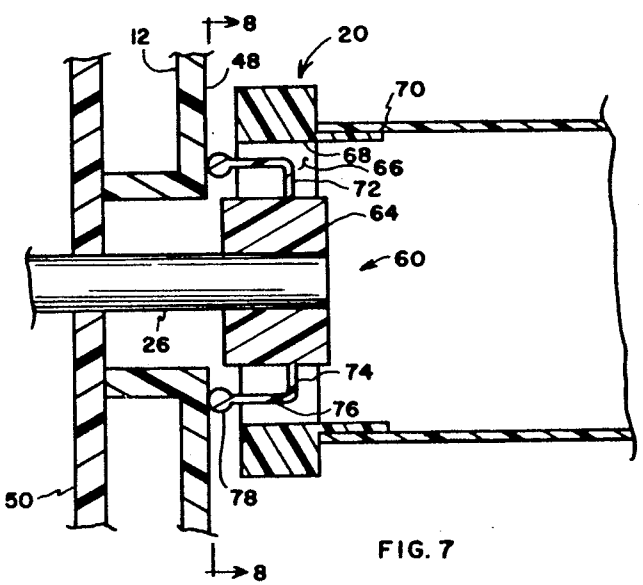
FIG. 7 is a partial sectional view similar to FIG. 1 illustrating an embodiment of the present invention wherein the buffering device is made integral with the helical gear.

FIG. 7 illustrates an embodiment of the present invention wherein a buffering member 60 is made integral with the gear. As seen in FIG. 7, member 60 is provided with an annular portion 64 which is secured by radially extending ribs 66 to an interior surface 68 of helical gear 20. Gear 20 includes a shoulder 70 to which the drum is secured (by adhesives, etc.). Buffering member 60 includes a plurality of extending fingers 72 having a base portion 74 radially extending from annular portion 64, a longitudinally extending portion 76, and a tip portion 78 at the ends of portion 76.

Figure 9:
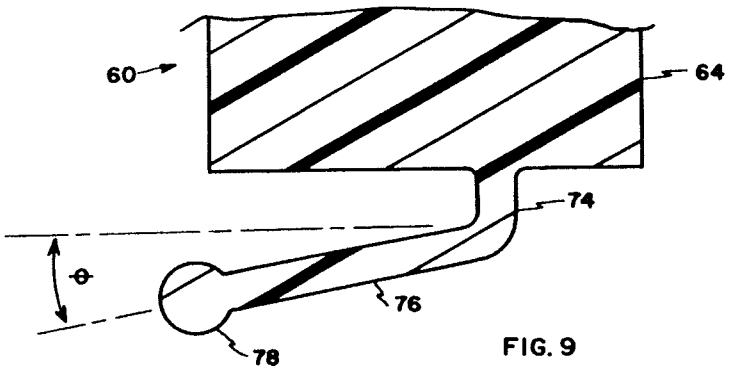
FIG. 9 is a partial enlarged view of the buffering device of FIG. 7 showing the extending contact fingers thereof disposed in angular relation.

FIG. 9 illustrates the longitudinally extending portions 76 of the buffering member as being angularly disposed (as indicated at Θ to permit an increased resiliency to be imparted by the fingers of the buffering member. Such resiliency is provided by the buffering member so as to permit a reciprocating motion between the drum and casing 12, if desired. Such resiliency may be also provided in the buffering members of the embodiments discussed supra if desired. The embodiment may also be made of electrically conductive plastic so as to serve as a ground for electrical charges provided to the drum during operation of the copier. Such electrically conductive materials are well known in the art. Typically, the electrical conductivity may be provided by embedding electrically conductive particles in the plastic material during the molding or casting process.

I claim:

1. A process cartridge for use in an image-forming apparatus comprising:

a casing;

a photosensitive member rotatably mounted in said casing;

a helical gear operatively coupled to said photosensitive member and adapted to receive driving force from the image-forming apparatus when mounted thereto to drive said photosensitive member, said photosensitive member being urged in a direction of its rotation axis responsive to rotation thereof by said helical gear; and buffering means including a member integral with said helical gear, said member including an extending portion disposed for coacting with said photosensitive member for providing a counter force thereagainst for preventing axial movement of said photosensitive member responsive to said urging of said photosensitive member in the direction of its rotation axis.

2. A process cartridge in an image-forming apparatus comprising:

a casing;

a photosensitive member rotatably mounted in said casing;

a helical gear operatively coupled to said photosensitive member and adapted to receive driving force from the image-forming apparatus when mounted thereto to drive said photosensitive member, said photosensitive member being urged in a direction of its rotation axis responsive to rotation thereof by said helical gear; and buffering means positioned adjacent to one end of said photosensitive member to absorb impact forces between predetermined engaging surfaces of said photosensitive member, said casing, and said image-forming apparatus responsive to said urging of said photosensitive member, said buffering means being a resilient member integral with said helical gear and operatively resiliently coupled with said drum and said predetermined surfaces for relative reciprocal motion therebetween.

3. Apparatus as set forth in claim 2 wherein said imageforming apparatus is provided with a shaft for support of said gear and said photosensitive member, said buffering member including an annular member having a central opening to receive said shaft therein.

4. Apparatus as set forth in claim 3 wherein said helical gear includes an inner annular surface and a forward face surface, said annular portion of said buffering member being concentrically mounted in said helical gear, a plurality of arms radially extending between said annular member and said inner annular surface of said helical gear for support of said annular member therein, and a plurality of resilient arm members extending from said annular member adjacent to and outward of said forward face surface.

5. Apparatus as set forth in claim 4 wherein said resilient arm members are provided with surface contacting tip portions on the distal ends thereof.

6. Apparatus as set forth in claim 5 wherein said resilient arm members are disposed in angular relation with the longitudinal axis of said buffering member.

7. Apparatus as set forth in claim 6 wherein said buffering means is electrically conductive plastic.

8. A process cartridge for use in an image-forming apparatus comprising:

a casing;

a photosensitive member rotatably mounted in said casing;

a helical gear operatively coupled to said photosensitive member and adapted to receive driving force from the image-forming apparatus when mounted thereto to drive said photosensitive member, said photosensitive member being urged in a direction of its rotation axis responsive to rotation thereof by said helical gear; and buffering means including a member having a convex-concave configuration positioned intermediate said casing and said helical gear and operatively coupled with said photosensitive member and said casing to absorb impact forces between predetemined engaging surfaces of said photosensitive member, said casing, and said image-forming apparatus responsive to said urging of said photosensitive member in the direction of its rotation axis.

9. Apparatus as set forth in claim 8 wherein said image-forming apparatus and said cartridge each includes an end wall, said end walls being disposed adjacent to one another in spaced relation, and said buffering member being mounted between said end walls.

10. Apparatus as set forth in claim 8 wherein said buffering means is provided with surfaces having a low coefficient of friction.

11. Apparatus as set forth in claim 10 wherein said buffering means is provided with surfaces having a low-friction coating.

12. Apparatus as set forth in claim 10 wherein said buffering means is electrically conductive.

* * * * *